United States Patent [19]

Wehrman

[11] Patent Number: 4,600,051

[45] Date of Patent: Jul. 15, 1986

[54] TANK-HEADER PLATE CONNECTION

[75] Inventor: James L. Wehrman, Kenosha, Wis.

[73] Assignee: Modine Manufacturing, Racine, Wis.

[21] Appl. No.: 631,893

[22] Filed: Jul. 13, 1984

[51] Int. Cl.[4] ..... F28F 9/02

[52] U.S. Cl. ..... 165/149; 165/173

[58] Field of Search ..... 165/149, 173, 175

[56] References Cited

U.S. PATENT DOCUMENTS

| | | | |
|---|---|---|---|
| 2,506,051 | 5/1950 | Young | 165/149 |
| 4,331,201 | 5/1982 | Hesse | 165/149 X |
| 4,461,348 | 7/1984 | Toge et al. | 165/149 X |
| 4,531,578 | 7/1985 | Stay et al. | 165/175 |

FOREIGN PATENT DOCUMENTS

| | | | |
|---|---|---|---|
| 54815 | 6/1982 | European Pat. Off. | 165/149 |

OTHER PUBLICATIONS

Patent Application Ser. No. 626,538 filed Jun. 28, 1984, to Stay et al.

*Primary Examiner*—Sheldon J. Richter

*Attorney, Agent, or Firm*—Wood, Dalton, Phillips, Mason & Rowe

[57] ABSTRACT

A connection for securing a tank to a header plate in a heat exchanger. A metal header plate is provided with a peripheral groove having a bottom wall and an upstanding side wall. A compressible gasket is received in the groove in a plastic tank as a flange disposed in the groove to compress the gasket. A plurality of tabs are deformed from the side wall to overlie a side of the flange and the side wall bent toward the tank. The tabs are generally egg-shaped or spherical and have free edges engaging the flange to provide excellent resistance to deformation.

7 Claims, 4 Drawing Figures

TANK-HEADER PLATE CONNECTION

FIELD OF THE INVENTION

This invention relates to heat exchangers of the type having a header plate supporting the open ends of a plurality of tubes and a tank secured to the header plate; and more specifically, to an improved connection between the tank and the header plate. It is an improvement on the invention disclosed in a commonly assigned U.S. patent entitled "Tank-Header Plate Connection", U.S. Pat. No. 4,531,578, issued July 30, 1985.

BACKGROUND OF THE INVENTION

Prior art of possible relevance includes the following U.S. patents, both to Hesse: U.S. Pat. No. 4,378,174 issued Mar. 29, 1983 and U.S. Pat. No. 4,331,201 issued May 25, 1982.

The effort by the automotive industry to reduce the weight of vehicles to thereby improve mileage has seen an increasing use of non-metallic materials in various parts of vehicles. Heat exchangers, more commonly termed radiators, are no exception. While metal materials are still employed in the cores for such heat exchangers because of their greater thermal conductivity over plastics, other heat exchanger components that do not require good thermal conductivity are being made of plastic. A primary example is the so-called tanks which are fitted to the heat exchanger core most typically by securement to the header plates which define the ends of such cores.

Because the joint between the header plate and the tank is one of dissimilar materials, prior techniques of brazing or soldering the joints can no longer be employed. In lieu thereof, to effect the necessary seal, a gasket is disposed between the tank and the header plate and any of a variety of means are employed to hold the components in assembled relation with the gasket under compression to assure a seal at the operating pressures for which the heat exchanger was designed.

It is, of course, necessary that the means employed to effect the connection be strong and long lived to prevent leakage. At the same time, it is desirable that the means be such that disassembly of the component parts can be effected when required for servicing. It is also desirable that the means utilized lend themselves to use in mass production to minimize cost.

Attempts to achieve these objects have resulted in proposals wherein a header plate is provided with a peripheral groove in which the gasket to be compressed may be disposed. The tank is provided with a peripheral flange sized to be received in the groove and adapted to compress the gasket therein. The outer wall of the groove is then deformed in part to overlie the flange on the tank and hold the same in a position compressing the gasket. This approach is exemplified by the above identified Hesse patents.

Unfortunately, because this approach involves deformation of a metal wall which necessarily may be sufficiently thin as to be easily deformed, the same may not always be as strong as might be desired. Pressure within the system during operation will act against the deformed material and tend to deform it back toward its original configuration. When such occurs, the compressive forces exerted on the gasket are lessened and leakage may occur.

In the previously identified co-pending commonly assigned application, there is disclosed an improved connection that obviates these difficulties. Specifically, semispherical tabs are formed to have free edges which overlie a tank flange to assemble the tank compressively against the gasket and the header plate.

This invention constitutes an improvement on that disclosure in the commonly assigned application and is intended to assure that such free edges of the tabs abut the flange over substantially the entire extent of such free edges.

SUMMARY OF THE INVENTION

It is the principal object of the invention to provide a new and improved connection between the header of a heat exchanger and a tank to be connected thereto. More specifically, it is an object of the invention to provide such a connection that is made by deformation and yet has sufficient strength to resist deformation back towards its original configuration.

An exemplary embodiment of the invention achieves the foregoing object in a structure including a metal header plate supporting the open ends of a plurality of tubes and provided with a gasket receiving area extending about the periphery of the header plate. The area has a bottom wall surrounded by a deformable side wall terminating in an edge. A compressible gasket is disposed in the area and a tank having an opening surrounded by an outwardly extending flange is provided. The flange is sized and configured to be fitted within the area with one side of the flange abutting the gasket and the opposite side of the flange being disposed within the area and spaced from the edge. The tank compresses the gasket so that the gasket effects a seal between the tank and the header plate. A plurality of tabs are disposed in the side wall below the edge and overlie the opposite side of the flange to hold the tank in compressing relation to the gasket. Each of the tabs is formed by deformation of the side wall to a generally nominally planar, free edge displaced from the side wall and in contact with the opposite side of the flange. Each such tab tapers from the free edge toward the side wall edge to merge into the side wall prior to or at the side wall edge and the side wall is deformed to at least partially overlie the flange.

In a highly preferred embodiment, the gasket receiving area is defined by a groove.

The invention also contemplates that the tabs merge into the side wall at locations spaced from the side wall edge.

Typically, the tank will be formed of plastic and in a highly preferred embodiment, each of the tabs is generally egg shaped or spherically shaped.

The chosen configuration of the tabs provides excellent force distribution to the side wall of the gasket receiving area or groove so as to provide excellent resistance to deformation back toward the original shape. At the same time, the tabs are easily formed according to mass production techniques and, where necessary, may be intentionally deformed back to their original configuration to allow disassembly of the components.

The tabs may be formed in the side wall by punching or piercing. No restraint is placed on the portion of the side wall wherein the tabs are formed such that such portion may be slightly bent toward the tank. Thereafter the side wall is rolled or bent from the vertical to partially overlie the flange such that the free edges of the tabs are parallel to the upper surface of the flange.

Other objects and advantages will become apparent from the following specification taken in connection with the accompanying drawings.

DESCRIPTION OF THE PREFERRED EMBODIMENT

Figure 1:
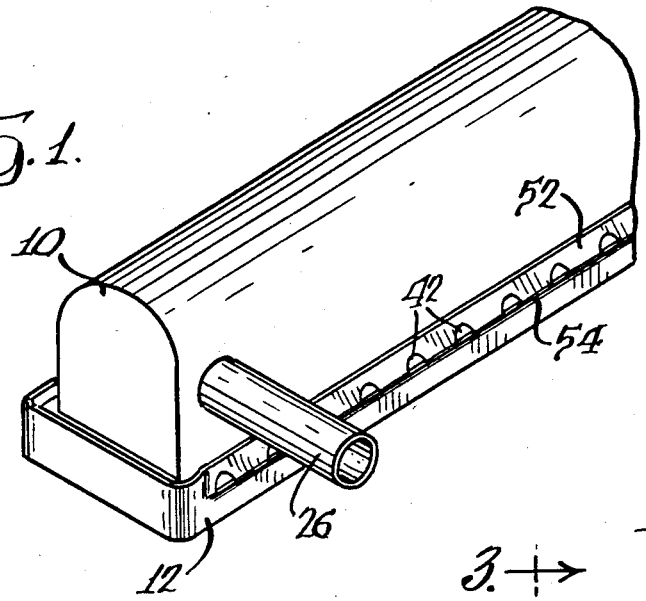
FIG. 1 is a perspective view of one embodiment of a tank assembled to a header plate by a connection made according to the invention.
Figure 2:
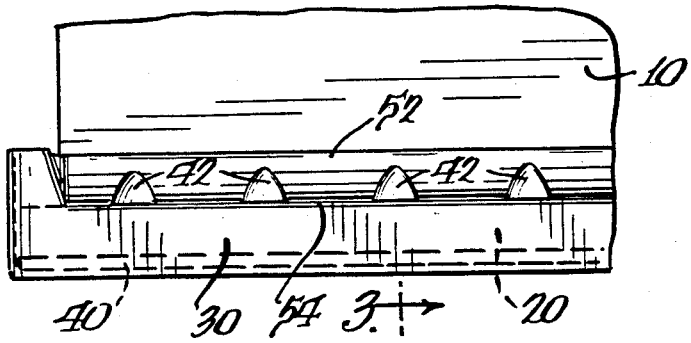
FIG. 2 is a fragmentary, enlarged elevation of the assembly just prior to a final fabrication step.
Figure 3:
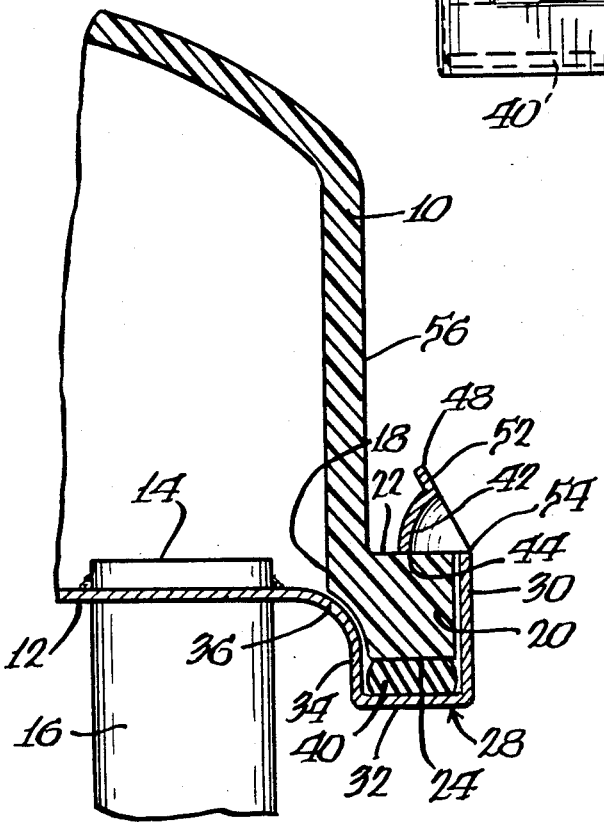
FIG. 3 is a further enlarged, sectional view taken approximately along the line 3—3 in FIG. 2.
Figure 4:
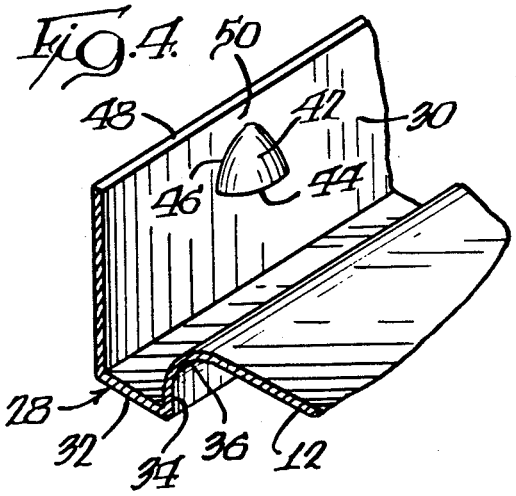
FIG. 4 is a fragmentary enlarged view of the header plate, just prior to a final fabrication step, with a tab formed therein but with the tank removed for clarity.

One exemplary embodiment of the invention is illustrated in the drawing and with reference to FIGS. 1 and 3 thereof, is seen to include a radiator tank 10, typically formed of plastic, and a header plate 12 formed of metal. Conventionally, the header plate 12 receives the open ends 14 of a plurality of tubes 16 (only one of which is shown). The tank 10 has an opening 18 which is surrounded by an outwardly directed flange 20 having upper and lower sides 22 and 24, respectively. One or more coolant ports 26 are provided for the tank 10. As best seen in FIG. 3, the header plate 12, at its periphery, includes a groove, generally designated 28. The groove 28 is defined by an upstanding, outer side wall 30, a bottom wall 32 and an inner wall 34 generally parallel to the outer wall 30 which merges with the main body of the header plate 12 by means of a round 36. As can be seen, the groove 28 and flange 20 are sized and configured so that the latter may be received in the former.

A compressible gasket 40 is disposed in the groove 28 in abutment with the bottom wall 32 thereof and the tank 10 oriented so that the flange 20 may be introduced into the groove 28. Upon introduction of the flange 20 into the groove, the surface 24 is brought into abutment with the gasket 40 and continued urging of the tank 10 toward the header plate 12 will result in the gasket 40 being compressed to the desired degree typically about 50% of its unstressed vertical dimension or diameter. In the usual case, somewhat more than the desired compression force will be placed on the components to allow a series of tabs 42 to be deformed from the wall 30 to overlie the surface 22 of the flange 20. When the tabs 42 have been formed, the compressive force may be released and the structure will assume the configuration illustrated in FIG. 3.

To assure good retentive strength and a resistance to deformation in response to pressure within the tank 10, the tabs 42 have the shape of one quadrant of a sphere or an egg. They include a curved lower free edge 44 which is nominally planar and overlies and abuts the surface 22 of the flange 20. The free edges 44 are typically formed at a distance above the bottom wall 32 equal to the sum of approximately 30% of the unstressed vertical dimension of the gasket 40 and the thickness of the flange 20. The tabs 42 gradually taper from their edges 44 toward the outer side wall 30 to merge therewith along a half oval or half circular shaped line 46. Generally, the merger will be complete before the edge 48 of the sidewall 30 is reached such that a space 50 exists between the edge 48 and the tab 42.

The tabs may be formed in one single operation with an appropriate shaped tool which effectively pierces the outer wall 30 to define a free edge 44 while deforming a portion of the wall 30 to define the body of the tab 42. This forming process is readily adaptable to mass production techniques.

To simplify the assembly operation, and to minimize the tooling required, the upper portion 52 of the side wall 30 wherein the tabs 42 are formed is not restrained oppositely of the advancing punching or piercing tool during the punching or piercing operation. This in turn may result in the upper portion 52 of the side wall 30 being slightly bent toward the tank 10.

Because the tabs 42 are formed by deforming metal, metal flow during the forming operation may result in the free edges 44 of the tabs being increasingly spaced from the upper surface of the flange 20 in the direction away from the side wall 30 and toward the tank 10. Consequently, to bring the entire extent of each free edge 44 into contact with the upper surface of the flange 20, following the operation wherein the tabs 42 are formed, the upper portion 52 of the side wall is further bent along a line 54 approximately at the level of the free edges 44 in the direction of the tank 10. As a consequence, the upper portion 52 of the side wall 30 will remain upstanding but will partially overlie the flange 20 and the free edges 44 will be parallel to and abut the upper surface of the flange 50. The bending operation can be performed by any suitable process as, for example, by rolling. In a preferred embodiment, the upper portion 52 is bent approximately 30° from the vertical toward the tank 10.

It will be appreciated that when necessary, the tabs 42 may be deformed back to their original shape if, for any reason, it is necessary to remove the tank 10 from the remainder of the assembly. In this regard, it is desirable that the tabs 42 or the upper portion 54 of the side wall 30 do not extend inwardly to be in contact with a side wall 56 of the tank 10 so as to allow insertion of a tool to accomplish such deformation.

Finally, it will also be appreciated that the geometry of the tabs 42 assures that forces tending to separate the tank 10 from the header plate 12 will be evenly distributed to the outer wall 30 to resist deformation of the same that could result in release of compressive force on the gasket 40 that could in turn result in leaks. The free edges 44 provide a substantial zone of contact with the flange surface 22 and such forces as are placed against the edges 44 are distributed to the remainder of the respective tab 42 which will be placed in compression without an appreciable bending moment applied thereto. Consequently, an extremely reliable and easily formed connection is provided by the invention.

What is claimed is:

1. A connection for securing a tank to a header plate in a heat exchanger comprising:

a metal header plate supporting the open ends of a plurality of tubes;

a groove extending about the periphery of said header plate and having a bottom wall surrounded by an upstanding, deformable side wall terminating in an edge;

a compressible gasket in said groove;

a plastic tank having an opening surrounded by an outwardly extending flange, said flange being sized and configured to be fitted within said groove with one side of the flange abutting said gasket and the opposite side of the flange within the groove and spaced from said edge, said tank compressing said gasket so that said gasket effects a seal between said tank and said header plate; and a plurality of tabs in said side wall below said edge and overlying said opposite side to hold said tank in compressing relation to said gasket, each said tab being formed by deformation and piercing of said side wall to having a generally curved nominally planar, free edge in contact with said opposite side of said flange and tapering from said free edge toward said side wall edge to merge into said side wall prior to or at said side wall edge;

said side wall, in the area of said tabs merging into said side wall and in the area above said free edges, being deformed toward said tank to at least partially overlie said flange and to assure abutment of said free edges with said flange.

2. The connection of claim 1 wherein each said tab is generally egg-shaped or spherical.

3. The connection of claim 1 wherein each said tab merges into said side wall at a location spaced from said side wall edge.

4. The connection of claim 1 wherein said side wall, above said free edges is deformed approximately 30° toward said tank to at least partially overlie said flange.

5. A connection for securing a tank to a header plate in a heat exchanger comprising:

a metal header plate supporting the open ends of a plurality of tubes;

a gasket receiving area extending about the periphery of said header plate and having a bottom wall surrounded by a deformable side wall terminating in an edge;

a compressible gasket in said groove;

a tank having an opening surrounded by an outwardly extending flange, said flange being sized and configured to be fitted within said groove with one side of the flange abutting said gasket and the opposite side of the flange within the area and spaced from said edge, said tank compressing said gasket so that said gasket effects a seal between said tank and said header plate; and a plurality of tabs in said side wall below said edge and overlying said opposite side to hold said tank in compressing relation to said gasket, each said tab being formed by deformation and piercing of said side wall to having a nominally planar, free edge displaced from said side wall to in contact with said opposite side of said flange, each said tab tapering from said free edge toward said side wall edge to merge into said side wall at a location spaced from said side wall edge;

said side wall being bent toward said tank.

6. A connection for securing a tank to a header plate in a heat exchanger comprising:

a metal header plate supporting the open ends of a plurality of tubes;

a groove extending about the periphery of said header plate and having a bottom wall surrounded by an upstanding, deformable, outer side wall terminating in an edge and by an inner side wall generally parallel to said outer wall;

a compressible gasket in said groove;

a plastic tank having an opening surrounded by an outwardly extending flange, said flange being sized and configured to be fitted within said groove with one side of the flange abutting said gasket and the opposite side of the flange within the groove and spaced from said edge, said tank compressing said gasket so that said gasket effects a seal between said tank and said header plate; and a plurality of tabs in a portion of said outer side wall below said edge and overlying said opposite side to hold said tank in compressing relation to said gasket, each said tab being formed by deformation being generally egg or spherically shaped and of said portion of said outer side wall to having a generally curved nominally planar, free edge in contact with said opposite side if said flange and tapering from said free edge toward said side wall edge to merge into said portion of said outer side wall prior to or at said side wall edge;

the portion of said outer side wall having said tabs being deformed toward said tank to bring said free edges into positive abutment with said flange opposite side.

7. The connection of claim 6 wherein each said tab merges into said outer side wall at a location spaced from said outer side wall edge.

* * * * *